United States Patent [19]

Kataoka

[11] 4,188,270

[45] Feb. 12, 1980

[54] PROCESS FOR ELECTROLYTICALLY FORMING GLOSSY FILM ON ARTICLES OF ALUMINUM OR ALLOY THEREOF

[76] Inventor: Akiyoshi Kataoka, Kabushiki Kaisha Shokosha nai, 8-16, Higashi 1-chome, Hanaten, Tsurumi-ku, Osaka, Japan

[21] Appl. No.: 940,730

[22] Filed: Sep. 8, 1978

[51] Int. Cl.[2] ..... C25D 11/08; C25D 11/10; C25D 11/20

[52] U.S. Cl. ..... 204/42; 204/58

[58] Field of Search ..... 204/58, 42

[56] References Cited

U.S. PATENT DOCUMENTS 4,022,670 5/1977 Dean ..... 204/58

*Primary Examiner*—R. L. Andrews

*Attorney, Agent, or Firm*—Larson, Taylor and Hinds

[57] ABSTRACT

A process for electrolytically treating an article of aluminum or alloy thereof to form a glossy film thereon, the process comprising the step of subjecting the article to electrolysis in an aqueous alkaline bath containing sodium phosphate and at least one compound selected from the group consisting of organic acids, inorganic acids and salts thereof under the conditions of a bath temperature of 20° to 90° C. and a current density of 0.5 to 80 A/dm$^2$.

9 Claims, No Drawings

PROCESS FOR ELECTROLYTICALLY FORMING GLOSSY FILM ON ARTICLES OF ALUMINUM OR ALLOY THEREOF

The present invention relates to improvements in the electrolytic treatment of aluminum or aluminum alloy articles to form a glossy film thereon.

Glossy films are formed on surfaces of aluminum or aluminum alloy articles usually by a process comprising the two steps of polishing the surface of the article first and subjecting the polished article to anodic oxidation to produce an anodized film thereon. For example, it is practiced to electropolish the workpiece with a phosphoric acid solution having a high concentration of at least 50% to form a glossy surface and treating the resulting workpiece by anodic oxidation, or to electropolish an aluminum alloy article in the usual manner and forming an oxide film on the polished article.

Thus the conventional process for forming glossy films requires two steps, namely polishing treatment and anodizing treatment and therefore has the drawbacks of being cumbersome to practice, unsuited to commercial operation and very uneconomical.

The polishing treatment is carried out by a chemical method using a polishing solution containing phosphoric acid, nitric acid or the like in a high concentration, or by an electropolishing method which uses an acid solution of sulfuric acid, nitric acid, phosphoric acid or the like, with or without chromic anhydride or bichromic acid added to the solution.

The chemical polishing method involves an increased equipment cost because the container for the treating bath and other devices must be made from acid-resistant material such as stainless steel for use with the acid solution.

Additionally the polishing bath for this method is used as heated to a high temperature of 100° to 120° C. in may cases and, moreover, must be vigorously agitated to ensure satisfactory results. The bath gives off a vapor or gas which is deterimental to the health of workmen and neighboring people, thus posing a serious pollution problem while causing corrosion to the equipment of the factory and presenting difficulties in its maintenance.

The electropolishing method, which uses an acid electrolyte, similarly requires the use of acid-resistant material for the bath container and other devices. Among other things, the holder for retaining the workpiece in the bath and passing current therethrough can be resistant to the electrolyte and yet highly conductive only when made from a specified metal such as titanium, which in turn renders the holder expensive. Such limitations on the material usable for these devices are in no way favorable to commercial operation.

Furthermore, the use of chromium or like heavy metal in the electropolishing method involves the likelihood that the heavy metal will be run off as contained in the effluent. In fact, such effluent has produced serious pollution problems in recent years.

To overcome the drawbacks of the known methods described above, I have conducted extensive research and accomplished this invention.

The main object of this invention is to provide a process for electrolytically treating articles of aluminum or alloy thereof with a specific alkaline electrolytic bath containing sodium phosphate under specified conditions to form a glossy film on the articles in a single step.

Another object of this invention is to provide a process for electrolytically treating articles of composite structure composed of an aluminum or aluminum alloy component and an iron, copper, stainless steel or some other metal component which are joined together as by fusing, welding, crimping or molding to form a glossy film on the surface of the aluminum or alloy component in a single step without the necessity of masking the article that would be required for acid bath treatment.

Another object of this invention is to provide a process for forming a colored glossy film on the surface of aluminum alloy articles in a single step.

To fulfil the foregoing objects, the present invention provides a process for electrolytically treating an article of aluminum or alloy thereof to form a glossy film thereon, the process comprising the step of subjecting the article to electrolysis in an alkaline bath containing sodium phosphate and at least one compound selected from the group consisting of organic acids, inorganic acids and salts thereof under the conditions of a bath temperature of 20° to 90° C. and a current density of 0.5 to 80 A/dm$^2$.

According to the present invention, the glossy film resulting from the above process can be subjected to electrolysis again with use of an organic acid or inorganic acid.

With the process of this invention, it is critical that the electrolytic bath comprise sodium phosphate. In fact, I have found that the specific alkaline bath containing sodium phosphate, when used, gives very glossy films in a single step.

The present invention will be described below in greater detail.

The electrolytic bath to be used in this invention contains sodium phosphate in a concentration of 10 to 500 g/liter, preferably 15 to 300 g/liter, as dissolved in water. Electrolytes containing less than 10 g/liter of sodium phosphate will give the resulting film gloss which, however, involves interference of light and are accordingly undesirable. Use of more than 500 g/liter of sodium phosphate or presence of the phosphate to saturation will produce little or no influence on the gloss and is rather advantageous in permitting the treatment at a lower temperature but requires a somewhat prolonged period of time for the treatment. For commercial operation, therefore, it is unnecessary to use more than 500 g/liter of sodium phosphate.

Examples of useful organic acids which can be incorporated into the bath are phenolic carboxylic acids such as salicylic acid; oxy acids such as glycolic acid, tartaric acid, citric acid and gluconic acids; and dibasic acids such as oxalic acid and glutaric acid. Also useful are potassium, sodium and ammonium salts of these organic acids.

Examples of useful inorganic acids which can be incorporated into the present bath are phosphoric acid, metaphosphoric acid, boric acid, metaboric acid, sulfuric acid and carbonic acid. Also useful are potassium, sodium and ammonium salts of these inorganic acids.

These organic acids, inorganic acids and salts thereof coact with sodium phosphate under the electrolytic conditions specified in this invention, assisting in forming glossy films while serving to produce colored films on aluminum alloy workpieces. To ensure such effects, it is preferable to use these organic acids, inorganic acids and salts thereof in a concentration of 5 to 500 g/liter. With use of less than 5 g/liter of such a compound, the compound will not produce a satisfactory synergic effect with sodium phosphate on the formation of glossy films or colored films. In combination with sodium phosphate, the organic acids, inorganic acids and salts thereof exemplified above may be used singly or at least two of three compounds are usable in admixture.

The principal electrolytic treatment of this invention must be carried out under alkaline conditions. Thus the electrolytic bath should have a pH value of greater than 7, preferably in the range of 8 to 13. At a neutrality pH value of about 7, the bath is unable to form films having a satisfactory gloss value.

Further according to this invention, the electrolytic treatment needs to be conducted with the bath adjusted to a temperature of 20° to 90° C. At temperatures lower than 20° C., films will not be formed satisfactorily, while films, if obtained, will have poor gloss. Conversely at temperatures higher than 90° C., the oxide film once produced starts to dissolve. Thus higher temperatures fail to give films of desired thickness and further permit marked evaporation of the bath, consequently presenting difficulties in the operation. It is preferable to use the bath at a temperature of 40° to 60° C. This imparts a high degree of gloss to the resulting film and favors the operation.

The current density for the treatment of this invention, although variable with factors such as the concentration, pH value and temperature of the electrolyte, is usually 0.5 to 80 A/dm$^2$, preferably 1 to 60 A/dm$^2$.

The more vigorously the bath is agitated, the better will be the result achieved by the present process. For this purpose, the electrolyte can be agitated with air injected thereinto or otherwise made to flow in the same manner as conventionally practiced in the anodic oxidation of aluminum.

The objects of this invention can be achieved with use of direct current, alternating current, superposed alternating and direct currents, pulse current or a combination of such currents.

The electrolytic treating time may be suitably determined in accordance with the composition, temperature and pH of the bath, current density and like factors. At high temperatures, a higher degree of gloss is available within a shorter period of time with a smaller film thickness, whereas at lower temperatures, promoted film formation tends to result, giving films with an increased thickness but reduced gloss.

When articles made of aluminum alloy are treated according to this invention under the conditions specified above, the alloy components produce a glossy colored film under the action of the electrolytic bath. Examples of useful aluminum alloys for forming colored films are those composed of at least one of manganese, magnesium, zinc, silicon, copper, chromium, etc. Colored glossy films formed on such aluminum alloys are, for example, pale reddish purple on alloy plates A3003P, pale reddish yellow on alloy bars A5052B, and light yellow on alloy plates A2014P and A2024P and on alloy shapes A5083S and A6061S wherein the designations are according to JIS.

According to the process of this invention described above in which an alkaline bath is used for electrolysis, the bath tank and other devices made of iron or like inexpensive material are usable, so that the equipment cost involved is lower than when a conventional acid bath is used. The material of the workpiece holder need not be limited to a specified one but a wide variety of materials are usable therefor. This ensures a higher efficiency in passing current through the workpiece and accordingly a greatly improved treating efficiency for commercial operation.

Additionally since the electrolytic treatment of this invention is carried out with use of an alkaline bath, articles of composite structure, such as sprocket wheels for bicycles, wheels for automobiles and motorcycles and chair legs, which are composed of an aluminum or aluminum alloy component and an iron, copper, stainless steel or some other material joined thereto as by fusing, welding, crimping or molding can be subjected to the electrolytic treatment without the necessity of masking the workpieces that is required for acid bath treatment. This assures another advantage for commercial operation.

The present process, which does not permit the emission of deterimental gas or vapor, greatly favors the health of workers, renders the equipment free of corrosion and does not release heavy metal or like harmful material which would pose pollution problems.

Examples of this invention will be given below.

EXAMPLE 1

Sodium phosphate and sodium tartrate were dissolved in water in concentrations of 10 g/liter and 50 g/liter respectively to prepare an electrolytic bath having a pH of 8.0. Each of specimens A1080P and A6063S which were not degreased was immersed in the bath at a temperature of 60° C. and anodized for one minute with 20-volt direct current at a current density of 8 A/dm$^2$, using a stainless steel cathode and a copper holder. The treatment produced a 1.5 μm thick glossy film on the specimen A1080P and a 1.0 μm thick glossy film on the specimen A6063S. The films were tested for specular gloss according to JIS Z 8741, Third Method with use of a glossmeter. The specimen A1080P had a gloss value of 88.0 and the specimen A6063S, 83.0.

EXAMPLE 2

Sodium phosphate and sodium citrate were dissolved in water in concentrations of 150 g/liter and 100 g/liter respectively to prepare an electrolytic bath having a pH of 13.2. The same specimens as used in Example 1 were immersed in the bath at a temperature of 60° C. and anodized for ten minutes with 20-volt direct current at a current density of 6 A/dm$^2$ using a carbon cathode and a copper holder. The treatment produced a 3.0 μm thick glossy film on the specimen A1080P and a 2.5 μm thick glossy film on the specimen A6063S. The films were tested for specular gloss in the same manner as in Example 1. The specimen A1080P had a gloss value of 88.0 and the specimen A6063S, 80.0.

EXAMPLE 3

Sodium phosphate and sodium gluconate were dissolved in water in concentrations of 100 g/liter and 20 g/liter respectively to prepare an electrolytic bath having a pH of 9.5. A specimen A1080P was electrolytically treated for two minutes in the bath at a temperature of 50° C. with 30-volt alternating current at a current density of 10 A/dm$^2$, using a pair of stainless steel electrodes spaced apart by 20 mm with the specimen attached to holder means while causing the electrolyte to flow at all times at a rate of 1.5 m/sec. The same procedure as above was repeated with use of a specimen A6063S. The treatment produced a 4.0 μm thick glossy film on each of the specimens with a gloss value of 89.0.

EXAMPLE 4

Sodium phosphate and potassium metaborate were dissolved in water in concentrations of 100 g/liter and 40 g/liter respectively to prepare an electrolytic bath having a pH of 10.0. Specimens A1080P were immersed in the bath at a temperature of 60° C. and anodized with 20-volt direct current at a current density of 15 A/dm$^2$, using an iron cathode and an iron holder while agitating the bath with air injected thereinto at a rate of 0.5 m$^3$/min. The treatment produced 2.0 μm, 4.0 μm and 6.0 μm thick glossy films in 4, 6 and 10 minutes respectively. The films had a gloss value of 83.0 to 89.0.

EXAMPLE 5

Sodium phosphate and ammonium borate were dissolved in water in concentrations of 200 g/liter and 50 g/liter respectively to prepare an electrolytic bath having a pH of 9.8. Two kinds of cast aluminum alloys AC7A and AC2A were immersed in the bath at a temperature of 45° C. and anodized for five minutes with 20-volt direct current at a current density of 7.0 A/dm$^2$, using a stainless steel cathode. The treatment produced a 5.0 μm thick glossy film on each of the specimens. The films had a gloss value of 80.0 to 81.0.

EXAMPLE 6

Sodium phosphate and ammonium sulfate were dissolved in water in concentrations of 200 g/liter and 20 g/liter respectively to prepare an electrolytic bath having a pH of 11.9. Composite specimens were also prepared, each being composed of two different metal plates which are joined together in contact with each other so as to have the same surface area. The combinations of metals used were aluminum and phosphor bronze, aluminum and iron, and aluminum and stainless steel. The specimens were immersed in the bath at a temperature of 50° C. and anodized for five minutes with 20-volt direct current at a current density of 15 A/dm$^2$, using a carbon cathode and a stainless steel holder which also served as the anode. The treatment produced a 3.0 μm thick glossy film on the aluminum surface of each specimen without dissolving the phosphor bronze, iron or stainless steel component. The films had a gloss value of 88.4.

EXAMPLE 7

Sodium phosphate and potassium oxalate were dissolved in water in concentrations of 100 g/liter and 50 g/liter respectively to prepare an electrolytic bath having a pH of 9.2. Aluminum alloy specimens A3003P and A5052B were immersed in the bath at a temperature of 40° C. and anodized for six minutes with 20-volt direct current at a current density of 8.0 A/dm$^2$, using a stainless steel cathode. The treatment produced a 2.0 μm thick, pale reddish purple, glossy film on the specimen A3003P and a 2.0 μm thick, pale reddish yellow, glossy film on the specimen A5052B.

EXAMPLE 8

Sodium phosphate, sodium tartrate and gluconic acid were dissolved in water in concentrations of 100 g/liter, 10 g/liter and 10 mg/liter respectively to prepare an electrolytic bath having a pH of 10.6. Specimens A1070S and A6063S were degreased and immersed in the bath at a temperature of 50° C. and anodized for ten minutes with 25-volt direct current at a current density of 4.5 A/dm$^2$. The treatment produced a 4.0 μm thick glossy film on each of the specimens with a gloss value of 82.0.

EXAMPLE 9

Sodium phosphate and citric acid were dissolved in water in concentrations of 100 g/liter and 15 g/liter respectively to prepare an electrolytic bath having a pH of 11.8. Specimens A1070P and A6063S were degreased and immersed in the bath at a temperature of 65° C. and anodized for six minutes with 35-volt direct current at a current density of 3.8 A/dm$^2$ using a stainless steel cathode and an iron holder which also served as the anode. The treatment produced a 2.5 μm thick glossy film on each of the specimens with a gloss value of 83.0.

EXAMPLE 10

Sodium phosphate, sodium tartate and phosphoric acid were dissolved in water in concentrations of 50 g/liter, 50 g/liter and 2 mg/liter respectively to prepare an electrolytic bath having a pH of 9.5. Specimens A1070P and A6063S were degreased and immersed in the bath at a temperature of 55° C. and anodized for six minutes with 35-volt direct current at a current density of 2.8 A/dm$^2$ using a stainless steel cathode and an iron holder which also served as the anode. The treatment produced a 3.0 μm thick glossy on each of the specimens with a gloss value of 80.0.

EXAMPLE 11

Sodium phosphate, tartaric acid and gluconic acid were dissolved in water in concentrations of 200 g/liter, 20 g/liter and 30 mg/liter respectively to prepare an electrolytic bath having a pH of 9.6. Specimens A1070P and A6063S were immersed in the bath at a temperature of 50° C. and anodized for four minutes with 30-volt direct current at a current density of 15 A/dm$^2$, using a stainless steel cathode and a stainless steel holder which served also as the anode. The treatment produced a 2.5 μm thick glossy film on each of the specimens with a gloss value of 84.0.

Each of the specimens obtained above with the glossy film formed thereon was further anodized for 20 minutes with a 14 w/V% solution of sulfuric acid at a temperature of 21° C. with 15-volt direct current at a current density of 1.8 A/dm$^2$, whereby about 14.5 μm thick glossy film was formed.

What I claim is:

1. A process for electrolytically treating an article of aluminum or alloy thereof to form a glassy film thereon, the process comprising the step of anodizing in an aqueous alkaline bath containing sodium phosphate and at least one compound selected from the group consisting of organic acids, inorganic acids and salts thereof under the conditions of a bath temperature of 20° to 90° C. and a current density of 0.5 to 80 A/dm$^2$.

2. A process as defined in claim 1 wherein the alkaline bath contains 10 to 500 g/liter of sodium phosphate.

3. A process as defined in claim 1 wherein the alkaline bath contains 10 to 500 g/liter of said at least one compound selected from the group consisting of organic acids, inorganic acids and salts thereof.

4. A process as defined in claim 1 wherein the organic acids are selected from the group consisting of phenolic carboxylic acids, oxy acids and dibasic acids.

5. A process as defined in claim 1 wherein the inorganic acids are selected from the group consisting of phosphoric acid, metaphosphoric acid, boric acid, metaboric acid, sulfuric acid and carbonic acid.

6. A process as defined in claim 1 wherein the salts of the organic and inorganic acids are selected from the group consisting of potassium, sodium and ammonium salts.

7. A process as defined in claim 1 wherein the alkaline bath has a pH of 8 to 13.

8. A process as defined in claim 1 wherein the aluminum alloy comprises at least one alloy element selected from the group consisting of manganese, magnesium, zinc, silicon, copper and chromium.

9. A process as defined in claim 1 wherein the glossy film formed is further electrolytically treated with an organic acid or inorganic acid.

* * * * *